US008920202B2

(12) United States Patent
Ames et al.

(10) Patent No.: US 8,920,202 B2
(45) Date of Patent: Dec. 30, 2014

(54) BUOYS AND METHOD OF ASSEMBLING THE SAME

(71) Applicants: Robert V. Ames, Warren, ME (US); Karen Vogt-Ames, Warren, ME (US)

(72) Inventors: Robert V. Ames, Warren, ME (US); Karen Vogt-Ames, Warren, ME (US)

( * ) Notice: Subject to any disclaimer, the term of this patent is extended or adjusted under 35 U.S.C. 154(b) by 0 days.

(21) Appl. No.: 13/751,820

(22) Filed: Jan. 28, 2013

(65) Prior Publication Data

US 2013/0196559 A1 Aug. 1, 2013

Related U.S. Application Data

(60) Provisional application No. 61/591,072, filed on Jan. 26, 2012.

(51) Int. Cl.

| | |
|---|---|
| ***B63B 22/00*** | (2006.01) |
| ***B63C 7/26*** | (2006.01) |
| ***B63B 3/02*** | (2006.01) |
| *B63B 5/24* | (2006.01) |
| *B63B 3/08* | (2006.01) |

(52) U.S. Cl.

CPC . *B63B 22/00* (2013.01); *B63B 5/24* (2013.01); *B63B 3/08* (2013.01); *B63B 2211/00* (2013.01); *B63C 7/26* (2013.01); *B63B 3/02* (2013.01); *B63B 2201/00* (2013.01)

USPC ..... 441/6

(58) Field of Classification Search

USPC ..... 441/1, 6, 32; 114/77 R; 220/4.26, 4.27

See application file for complete search history.

(56) References Cited

U.S. PATENT DOCUMENTS

| | | | | |
|---|---|---|---|---|
| 366,077 | A * | 7/1887 | Delaney | 441/1 |
| 1,380,402 | A * | 6/1921 | MacDonald | 220/4.26 |
| 3,942,203 | A * | 3/1976 | Perkins | 441/28 |
| 4,976,641 | A * | 12/1990 | D'Amico | 441/23 |
| 7,001,233 | B2 * | 2/2006 | Gotell | 441/1 |

* cited by examiner

*Primary Examiner* — Lars A Olson
*Assistant Examiner* — Andrew Polay
(74) *Attorney, Agent, or Firm* — Lowe Hauptman & Ham, LLP

(57) ABSTRACT

A buoy has a first piece with a first cavity defined by a first wall and a first open end of the first piece; a second piece having a second cavity defined by a second wall, a second open end and a second close end which is opposite to the second open end; and a separation piece to separate the first cavity and the second cavity so as to form two separated watertight compartments.

19 Claims, 16 Drawing Sheets

BUOYS AND METHOD OF ASSEMBLING THE SAME

This application claims the benefit of U.S. Provisional Application No. 61/591,072, filed Jan. 26, 2012, the entire contents of which prior application are hereby incorporated herein by reference.

TECHNICAL FIELD

The present disclosure generally relates to a buoy for retrieving a trap from the ocean floor. The present disclosure also relates to a method of assembling the buoy.

BACKGROUND

In order for a lobsterman to retrieve his trap from the ocean floor, sometimes several hundred feet down, he has a buoy floating on the surface to attach a rope from the trap so as to pull the rope. The trap can be retrieved from the ocean floor. In states where there are several thousand lobstermen, each lobsterman has his own unique color pattern on his buoy to identify their traps. This is done by painting their buoys with paint in a pattern that is their own identification and in most cases the buoys have to be painted every year.

BRIEF DESCRIPTION OF THE DRAWINGS

One or more embodiments are illustrated by way of example, and not by limitation, in the figures of the accompanying drawings, wherein elements having the same reference numeral designations represent like elements throughout and wherein:

FIG. 1(*b*) is a cross-section view of the buoy according to the first embodiment when the buoy is in an assembled state;

FIG. 1(*c*) is a top view of a buoy piece of the buoy according to a modification of the first embodiment;

FIG. 1(*d*) is a side view of the buoy piece of the buoy according to the modification of the first embodiment;

FIG. 2(*b*) is a cross-section view of the buoy according to the second embodiment when the buoy is in an assembled state;

FIG. 2(*c*) is a top view of a buoy piece of the buoy according to a modification of the second embodiment;

FIG. 2(*d*) is a side view of the buoy piece of the buoy according to the modification of the second embodiment;

FIG. 3(*b*) is a cross-section view of the buoy according to the third embodiment when the buoy is in an assembled state;

FIG. 4(*b*) is a cross-section view of the buoy according to the fourth embodiment when the buoy is in an assembled state;

FIG. 6(*b*) is a side view of the section of the buoy piece according to the embodiment of FIG. 6(*a*);

DETAILED DESCRIPTION

Typically buoys used in the fishing trade are 5" diameter× 11" long, 6" diameter×14" long or 9" diameter×16" long. Buoys can also be made bigger or smaller than the above mentioned size. Some fishermen use 2 buoys on a buoy stick for more buoyancy. Buoys in accordance with some embodiments would allow for making longer or shorter buoys as the need would be, a truly custom design. The buoys in accordance with some embodiments would lend to ease of use from small buoys or floats or in combinations of multiples for other much larger applications.

Figure 1:
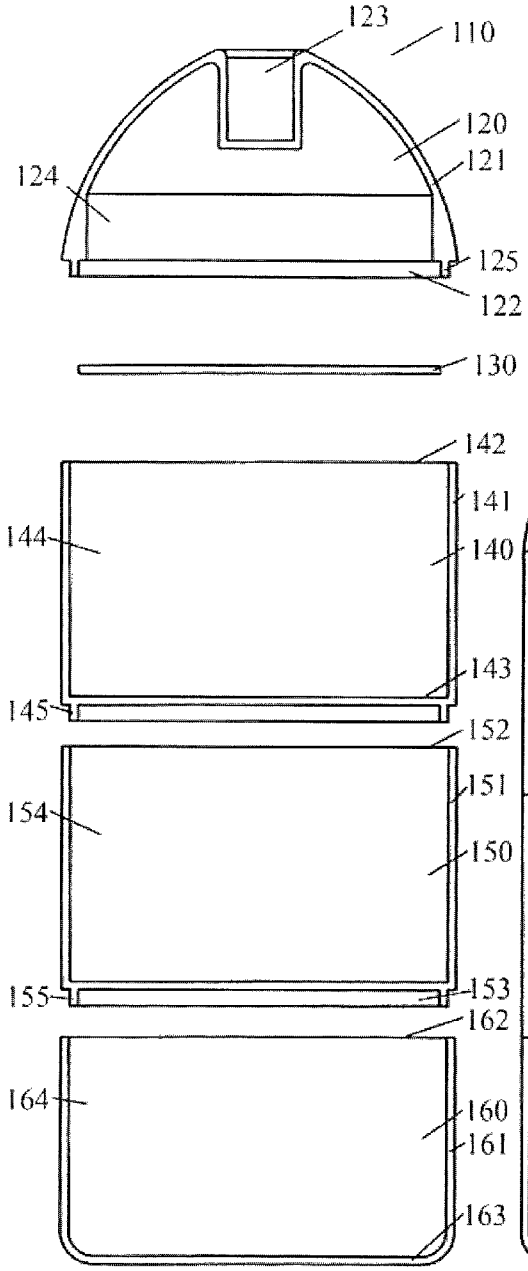
FIG. 1(*a*) is a cross-section view of pieces of a buoy according to a first embodiment.
Figure 1:
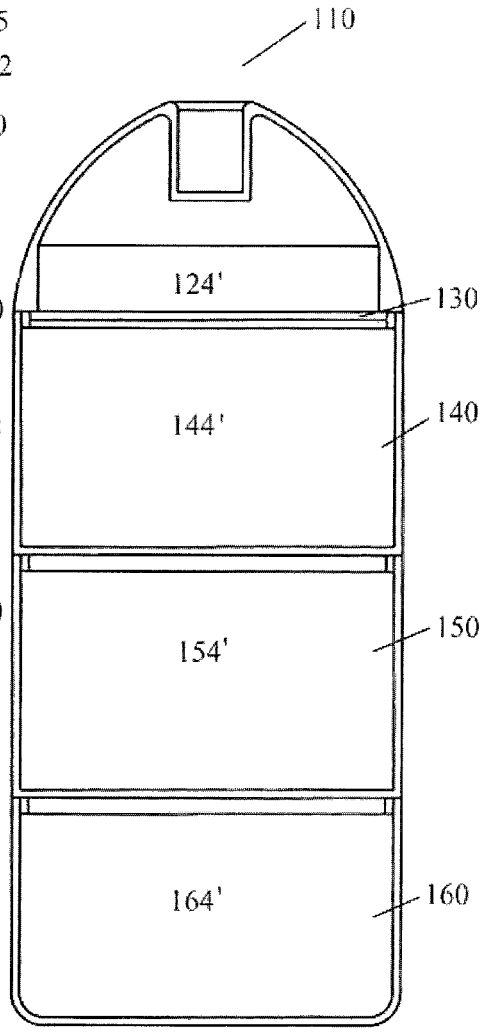
Figure 1:
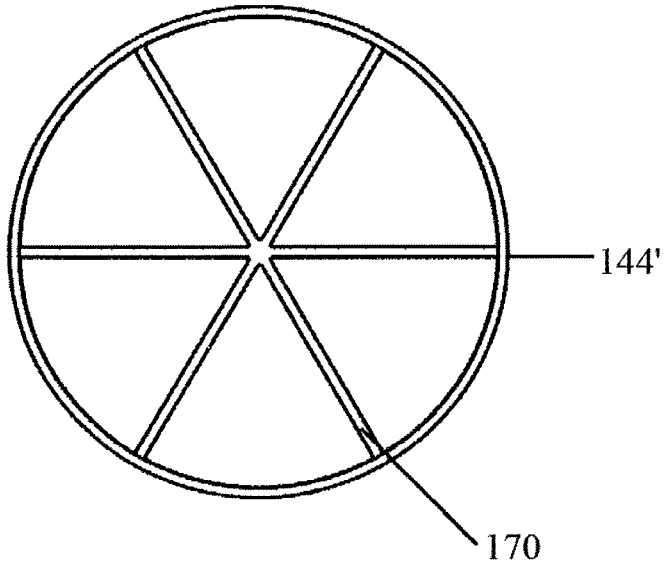
Figure 1:
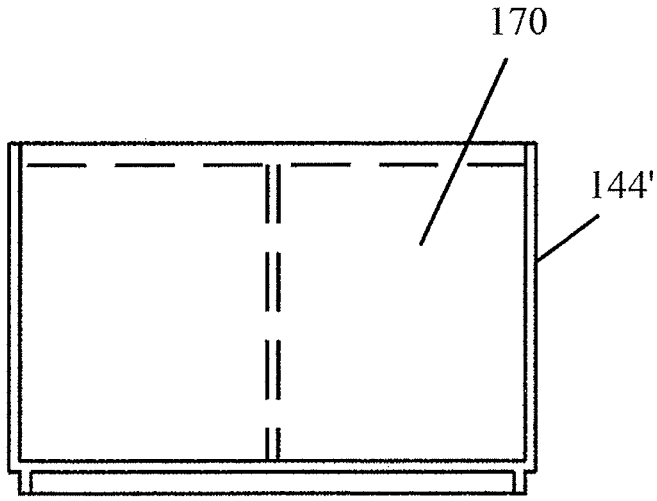

FIG. 1 (*a*) is a cross-section view of pieces of a buoy 110 according to at least one embodiment. The pieces include a first piece 120, a separation piece 130, a second piece 140, a third piece 150, and a fourth piece 160. The first piece 120, the separation piece 130, the second piece 140, the third piece 150, and the fourth piece 160 have a common central axis.

The first piece 120 in some embodiments is made blunt, square, bullet shaped and so forth as required for the desired shape to meet the application. Other shapes are not excluded. The first piece 120 has a first wall 121, a first open end 122, a first rim 125, and an attaching portion, such as a recess 123, for receiving an attachment, such as a rope, swivel etc. The recess 123 with attachments is further discussed later. A first cavity 124 is formed in the first piece 120.

The separation piece 130 is to separate the first cavity 124' and a second cavity 144' of the second piece 140 so as to form two separated watertight air compartments 124' and 144'. The outside diameter of the separation piece 130 in some embodiments is substantially same as the inside diameter of the first open end 122 of the first piece 120, and the separation piece 130 is a plate that is made of water impermeable material.

The second piece 140 has a second wall 141, a second rim 145, a second open end 142 and a second closed end 143 which is opposite to the second open end 142. The second cavity 144' is formed in the second piece 140. The second open end 142 fitly receives the first rim 125 and the separation piece 130.

The third piece 150 has a third wall 151, a third rim 155, a third open end 152 and a third closed end 153 which is opposite to the third open end 152. A third cavity 154 is formed in the third piece 150. The third open end 152 fitly receives the second rim 145.

The fourth piece 160 has a fourth wall 161, a fourth open end 162 and a fourth closed end 163 which is opposite to the fourth open end 162. A fourth cavity 164 is formed in the fourth piece 160. The fourth open end 162 fitly receives the third rim 155.

With those configurations, additional watertight air compartments 154' and 164' are formed. By making several watertight compartments, the buoy would still be able to float even if one or more of the compartments were compromised. Also, by making several compartments, the buoy would have increased structural integrity. If the application required it, the buoy's watertight compartments in some embodiments are filled with floatation material, such as Styrofoam beads, polypropylene beads, air filled spheres or any other floatation material. As such, in the case of water penetration, the buoy would still float enough to be able to be retrieved. In some embodiments, the buoy has sufficient buoyancy even if one or more of the compartments 124', 144', 154' and 164' are filled with water.

FIG. 1 (*b*) is a cross-section view of the buoy 110 when the buoy is in an assembled state. The first piece 120, the separation piece 130, the second piece 140, the third piece 150 and the fourth piece 160 are releasably press-fitted together. The first piece 120 is attached to the second piece 140. The separation piece 130 is located between the first piece 120 and the second piece 140. The second piece 140 is attached to the third piece 150. The third piece 150 is connected with the fourth piece 160 that is the bottom of the buoy 110. In some embodiments, one or more of the pieces 130, 140, 150 and 160 is/are omitted or added.

In some embodiments, the buoy pieces are glued, screwed, welded, snap together or otherwise held together by some other mechanical engagements to make a watertight joint.

FIG. 1 (*c*) is a top view of a buoy piece of the buoy according to a modification of the first embodiment where multiple plates are arranged inside of the buoy piece. FIG. 1 (*d*) is a side view of the buoy piece of the buoy according to the modification of the first embodiment in FIG. 1 (*c*). As illustrated in FIGS. 1(*c*)-(*d*), multiple plates 170 are provided inside the buoy piece 140 and intersect each other substantially at a center of the buoy piece 140 for adding strength against collapsing if the buoy goes beneath the water surface. The watertight air compartment 144' formed by the buoy piece 140 is divided by the multiple plates into several air compartments. The multiple plates 170 can be integrally formed in a single piece. Each plate 170 has both ends directly attached to an inner surface of the buoy piece 140. The number of the plates 170 is not limited to the disclosure in FIGS. 1(*c*)-(*d*).

Likewise, the buoy pieces 154 and 164 as shown in FIGS. 1(*a*) and 1(*b*) can also be provided with the multiple plates 170 as gussets to add strength against collapsing if the buoy goes beneath the water surface.

Figure 2:
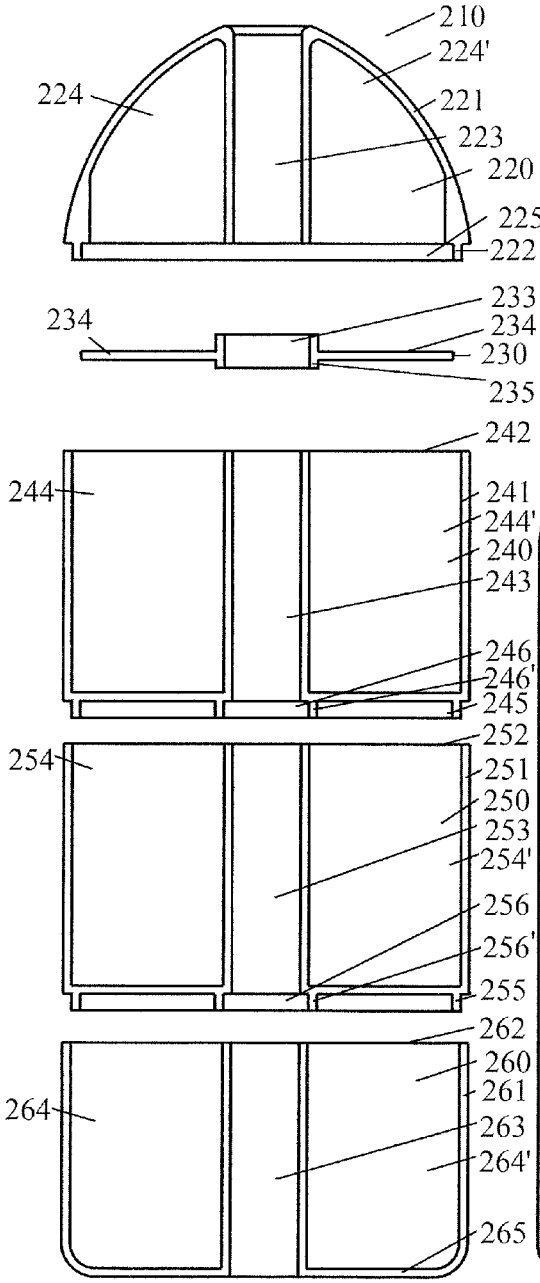
FIG. 2(*a*) is a cross-section view of pieces of a buoy according to a second embodiment.
Figure 2:
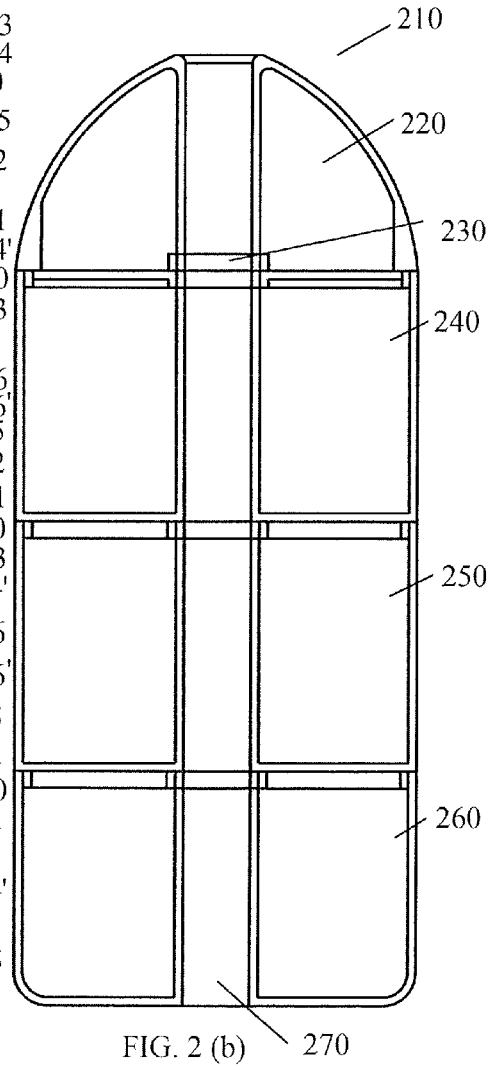
Figure 2:
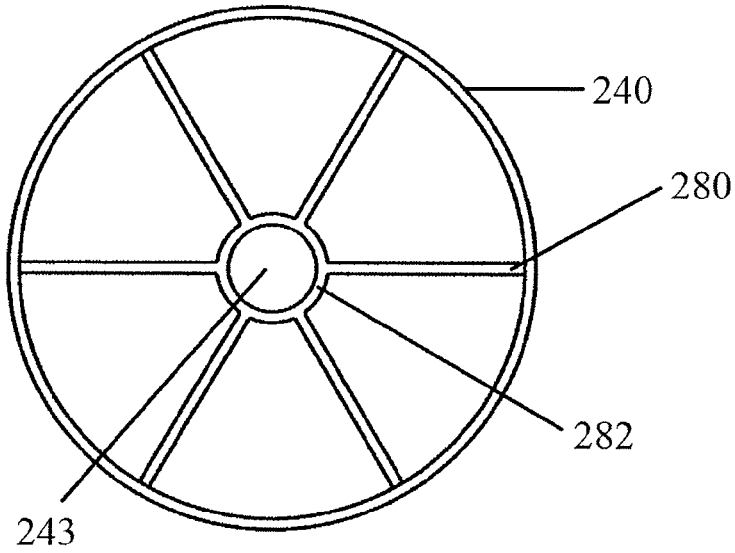
Figure 2:
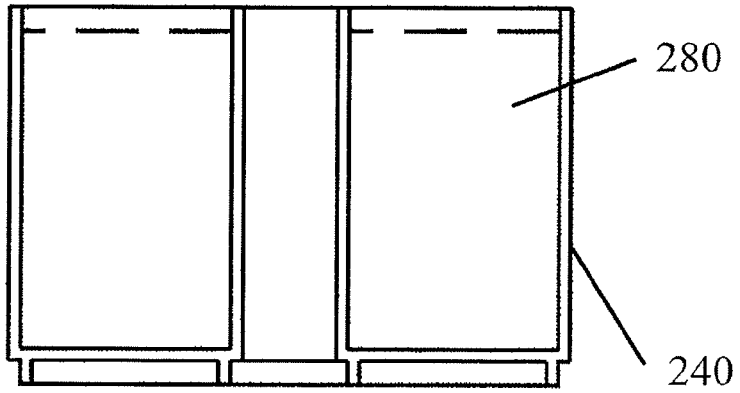

FIG. 2(*a*) is a cross-section view of pieces of a buoy 210 according to a second embodiment. The pieces of the buoy 210 include a first piece 220, a separation piece 230, a second piece 240, a third piece 250, and a fourth piece 260.

The first piece 220 has a first wall 221, a first open end 222, a first rim 225 and a first through hole 223. The first through hole 223 is in the center of the piece 220, which separates the piece into two or more cavities, 224 and 224'. In some embodiments, the cavities 224 and 224' are combined in a single annular cavity.

The separation piece 230 includes two portions, a first portion 234 and a second portion 235. The upper surface of the second portion 235 is higher than the upper surface of the first portion 234 and the lower surface of the second portion 235 is lower than the lower surface of the first portion 234. The second portion 235 includes a through hole 233, and the inside diameter of the hole 233 is substantially same as the inside diameter of the hole 223. The separation piece 230 is to separate the cavities 224, 224', 244 and 244' to form additional independent watertight air compartments. In some embodiments, the outside diameter of the first portion 234 is substantially same as the inside diameter of the open end 222 of the top piece 220, and the separation piece is made of water impermeable material.

The second piece 240 has a second wall 241, a second open end 242, a second closed end 245 and a second through hole 243. The second through hole 243 is in the center of the second piece 240, which separates the second piece 240 into two cavities 244 and 244'. The inside diameter of the second through hole 243 is substantially same as the inside diameter of the hole 233, so that the second open end 242 fitly receives the first open end 222 and the separation piece 230. The second closed end 245 includes a projection 246 having an inside wall 246'. The inside diameter of the inside wall 246' is substantially same as the outside diameter of a third through hole 253 of the third piece 250 so as to watertightly receive the third through hole 253 of the third piece 250. In some embodiments, the cavities 244 and 244' are combined in a single annular cavity.

The third piece 250 has a third wall 251, a third open end 252, a third closed end 255 and the third through hole 253. The third through hole 253 is in the center of the third piece 250, which separates the third piece 250 into two cavities 254 and 254', and the inside diameter of the third hole 253 is substantially same as the inside diameter of the second through hole 243. The third open end 252 fitly receives the second piece 240. The third closed end 255 includes a projection 256 having a third rim 256'. In some embodiments, the inside diameter of the third rim 256' is substantially same as the outside diameter of a fourth through hole 263 of the fourth piece 260 so as to watertightly receive the fourth through hole 263 of the fourth piece 260. In some embodiments, the cavities 254 and 254' are combined in a single annular cavity.

The fourth piece 260 has a fourth wall 261, a fourth open end 262, a fourth closed end 265 and a fourth through hole 263. The fourth through hole 263 is in the center of the fourth piece 260, which separates the fourth piece 260 into two cavities 264 and 264', and the inside diameter of the fourth through hole 263 is substantially same as the inside diameter of the third through hole 253. The open fourth end 262 fitly receives the third piece 250. In some embodiments, the cavities 264 and 264' are combined in a single annular cavity.

FIG. 2(*b*) is a cross-section view of the buoy 210 when the buoy is in an assembled state. By assembling the through holes 223, 233, 243, 253 and 263, a long through hole 270 is formed in the buoy 210 for a buoy stick, rope or pipe to pass through the buoy and stick out one or both ends for the point of attachment of a rope, swivel etc. In some embodiments, one or more of the pieces 230, 240, 250 and 260 is/are omitted or added.

In some embodiments, the watertight compartments are glued, screwed, welded, snap together or otherwise held together by some other mechanical engagements to make a watertight joint.

FIG. 2(*c*) is a top view of a buoy piece of the buoy according to a modification of the second embodiment where multiple plates are arranged inside of the buoy piece. FIG. 2 (*d*) is a side view of the buoy piece of the buoy according to the modification of FIG. 2(*c*). As illustrated in FIGS. 2(*c*)-(*d*), multiple plates 280 are provided inside the buoy piece 240 and connect to a center piece 282 which has a circular cross-section corresponding to the through hole 243 of the buoy piece 240 for adding strength against collapsing if the buoy goes beneath the water surface. The multiple plates 280 and the center piece 282 can be integrally formed in a single piece. Each plate 280 has both ends directly attached to an inner surface of the buoy piece 240 and to an outer surface of the center piece 282, respectively. The number of the plates 280 is not limited to the disclosure in FIGS. 2(*c*)-(*d*).

Likewise, the buoy pieces 250 and 260 can also be provided with the multiple plates 280 and the center piece 282 as gussets to add strength against collapsing if the buoy goes beneath the water surface.

Figure 3:
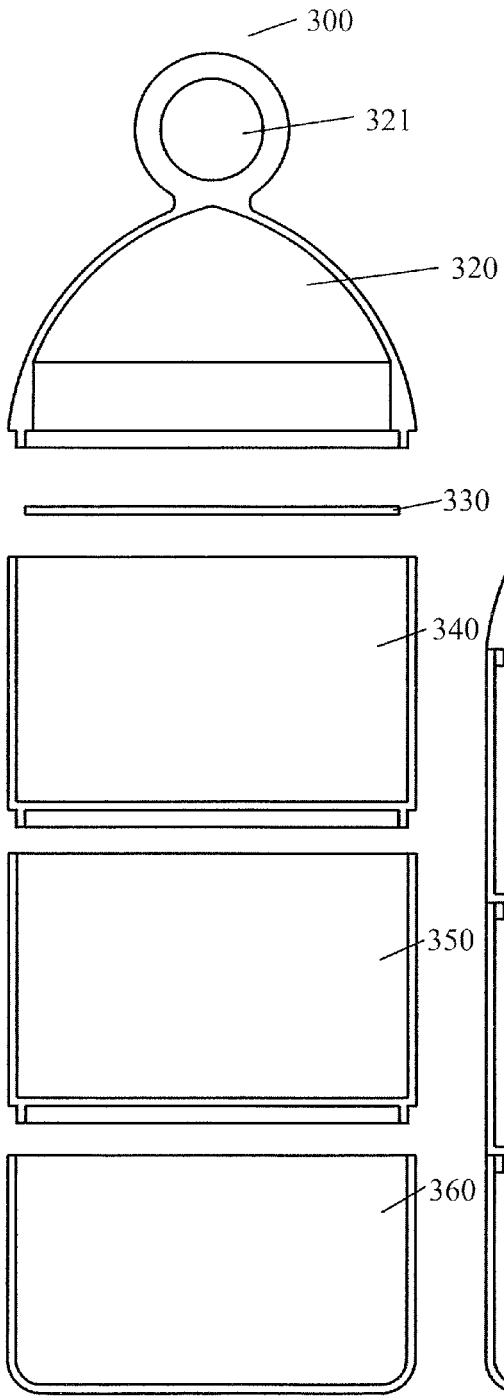
FIG. 3(*a*) is a cross-section view of pieces of a buoy according to a third embodiment.
Figure 3:
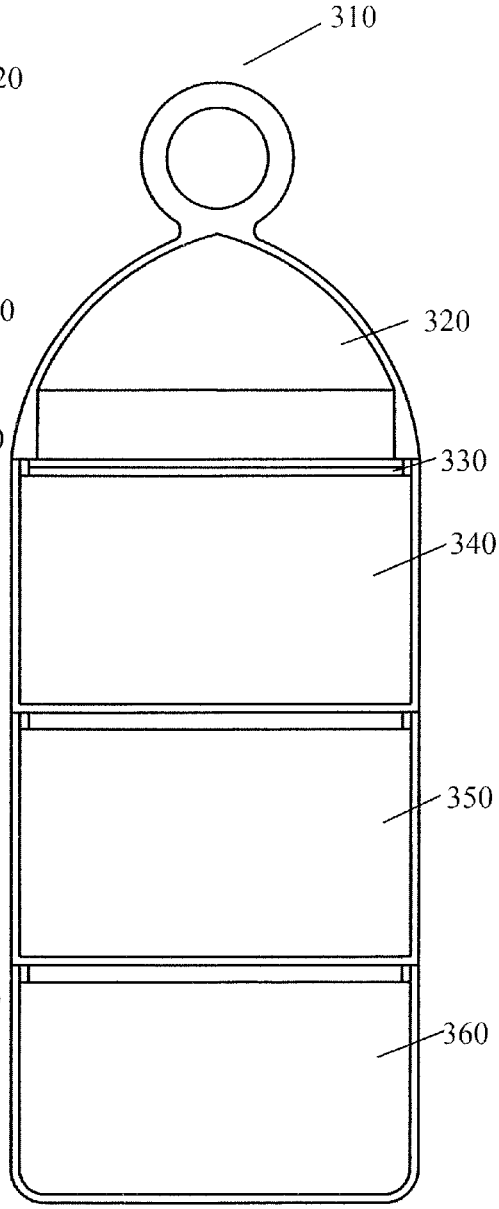

FIG. 3(*a*) is a cross-section view of pieces 300 of a buoy 310 according to a third embodiment. The pieces 300 comprise a first piece 320, a separation piece 330, a second piece 340, a third piece 350 and a fourth piece 360. The pieces 300 have similar features to the pieces of the buoy 110 except for the first piece 320. In the present embodiment, the first piece 320 has a round-shaped hole 321, so that a rope can be passed through the round-shaped hole 321. The first piece 320 in some embodiments can be made in other different shapes such as square, rectangle, multi sided or transition from one shape to another shape or from one size to another size. Other shapes are not excluded.

FIG. 3(*b*) is a cross-section view of the buoy 310 according to the third embodiment when the buoy is in an assembled state.

Figure 4:
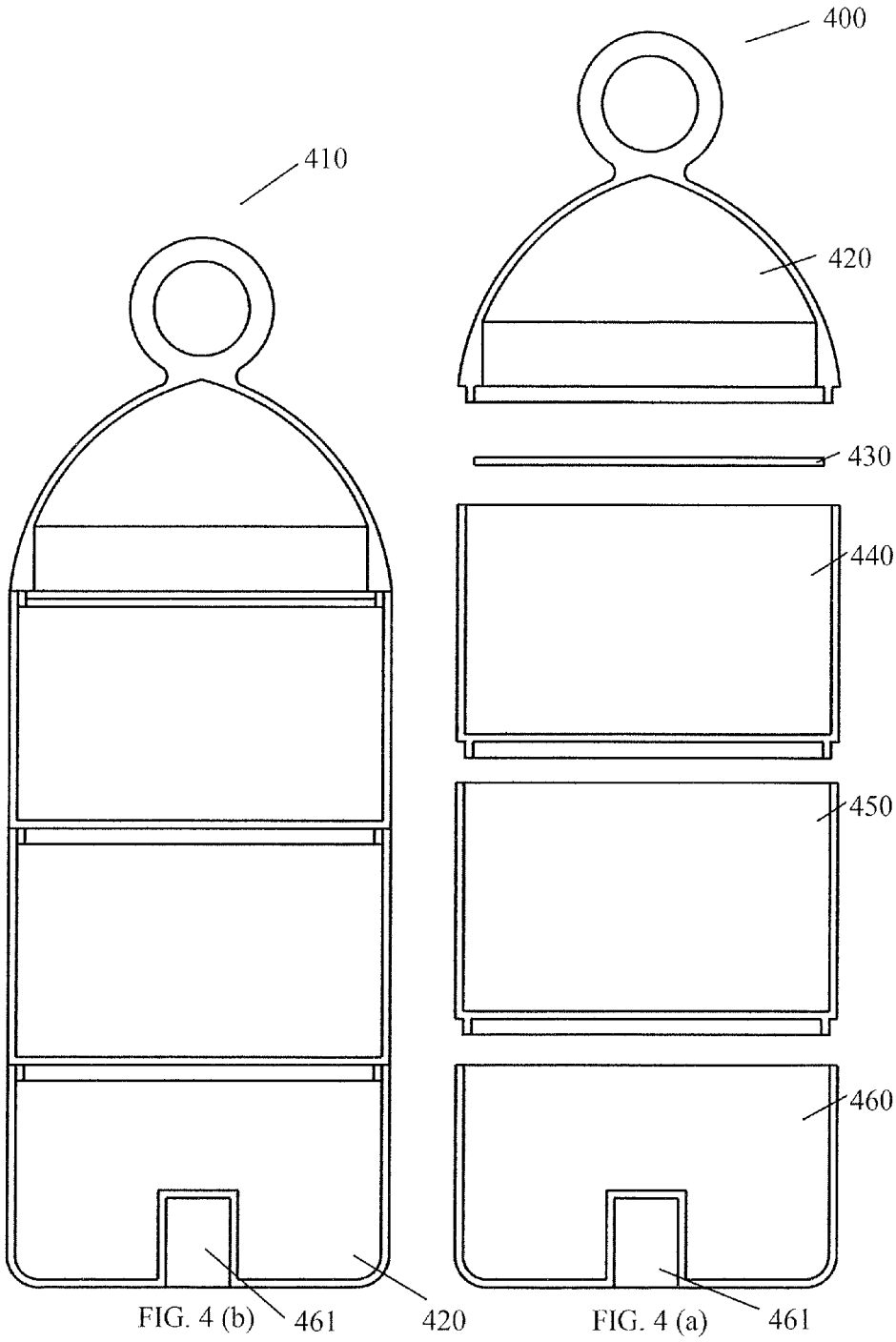
FIG. 4(*a*) is a cross-section view of pieces of a buoy according to a fourth embodiment.

FIG. 4(*a*) is a cross-section view of pieces 400 of a buoy 410 according to a fourth embodiment. The pieces 400 comprise a first piece 420, a separation piece 430, a second piece 440, a third piece 450 and a fourth piece 460. The pieces 400 have similar features with pieces 300 of the buoy 310 except for the fourth piece 460. The piece 460 has an attaching portion, such as a recess 461, for receiving an attachment, such as a rope, swivel etc.

FIG. 4(*b*) is a cross-section view of the buoy 410 when the buoy is in an assembled state.

The pieces that constitute the buoy can be made in many different diameters, lengths, color patterns and/or shapes by attaching different shaped pieces together, thus almost an endless variety of sizes, shapes and colors can be achieved for a variety of reasons.

Many plastic materials are available and could be used to make the buoys fit to different uses in various embodiments. The material and/or the melt index of the material can be changed to meet the required characteristics of the buoy, such as soft, flexible for the use as a boat bumpers, harder less flexible for buoys that would be unlikely drawn underwater surface, to real stiff and hard for the buoys that could be drawn well below the surface.

The pieces to be used to assemble the buoy can be made in any color and assembled in multiple arrangements for the fisherman's color identification. To further make a design unique to the fisherman or lobsterman, some embodiments include colored tapes to form stripes or rings on the pieces' surfaces. In some embodiments, the fisherman's name, license number and so forth are molded into one or more of the pieces of the buoy. The buoy pieces in some embodiments have the color pigments molded in them so as to eliminate the need for yearly painting.

In some embodiments, the pieces are assembled into the buoy. The same or similar pieces are assembled in further embodiments into other floatable things used in other applications, such as but not limited to, posts for bird feeders, lamps, holding up tents, floats under docks, boat fenders etc.

Figure 5:
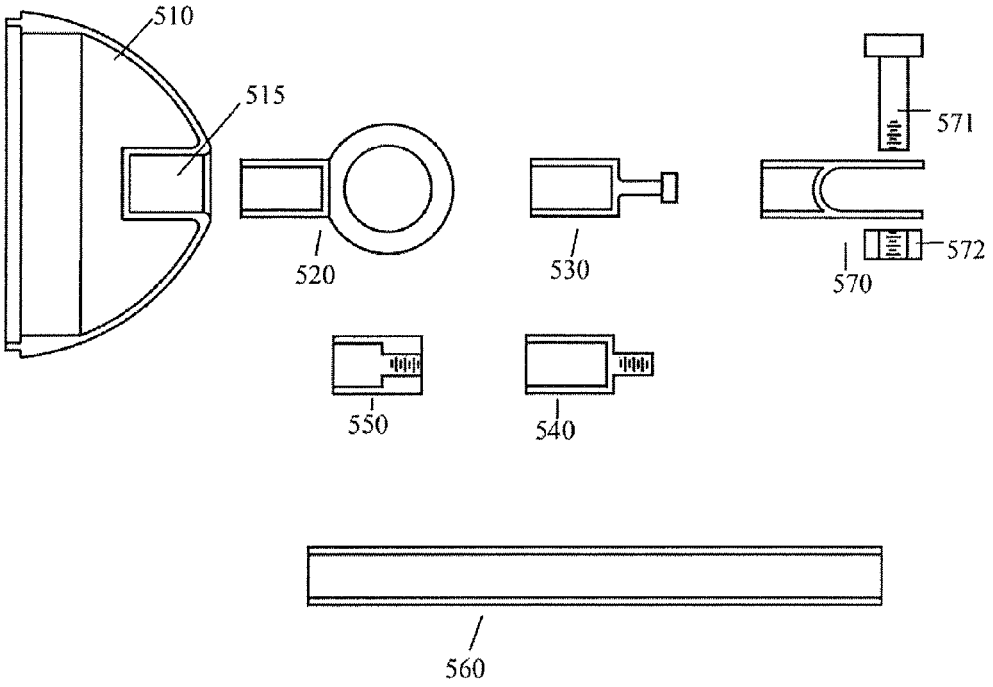
FIGS. 5(*a*)-(*g*) are cross-section views of the top piece of a buoy with a recess in accordance with some embodiments and various attachments attachable to the top piece.
Figure 5:
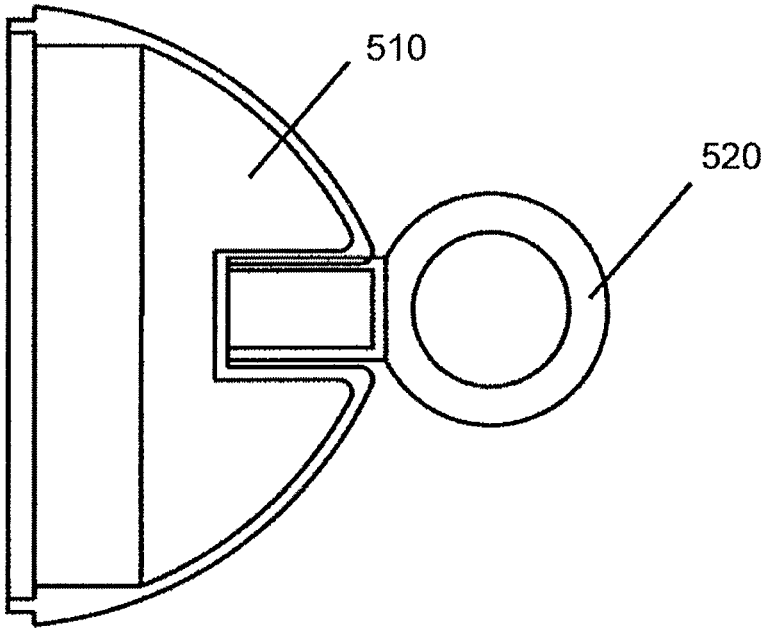
Figure 5:
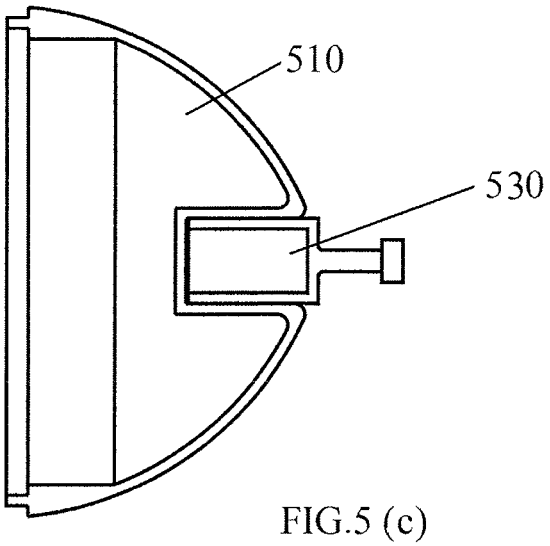
Figure 5:
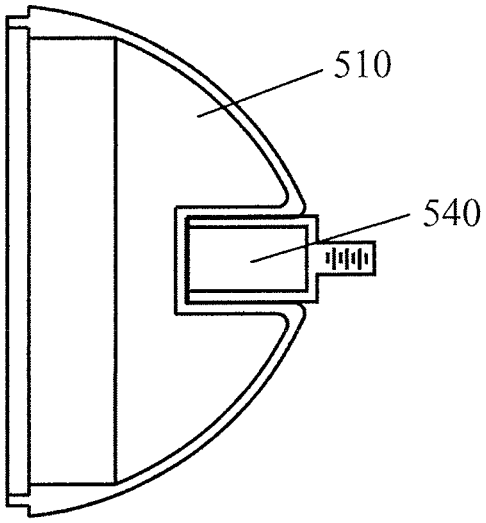
Figure 5:
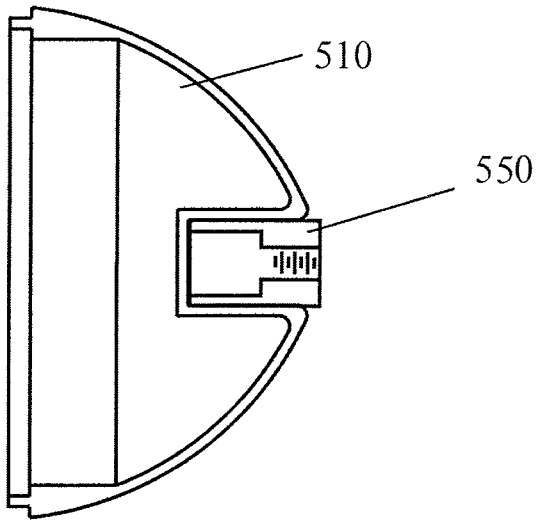
Figure 5:
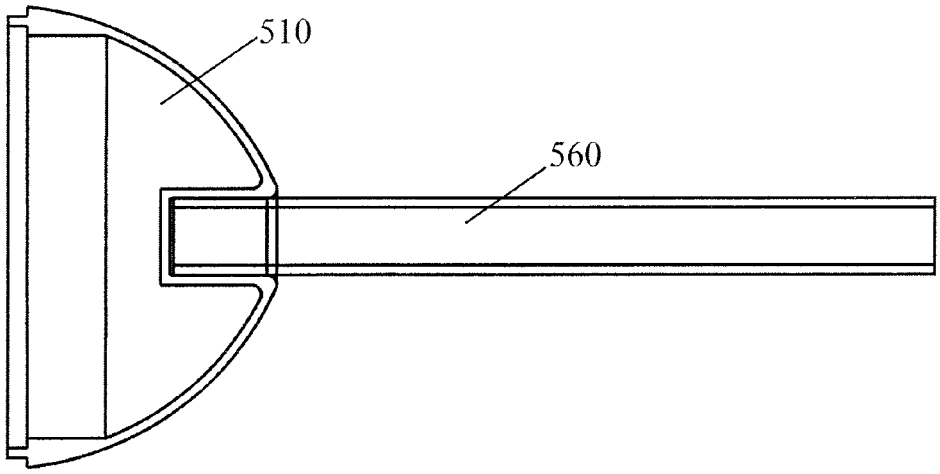
Figure 5:
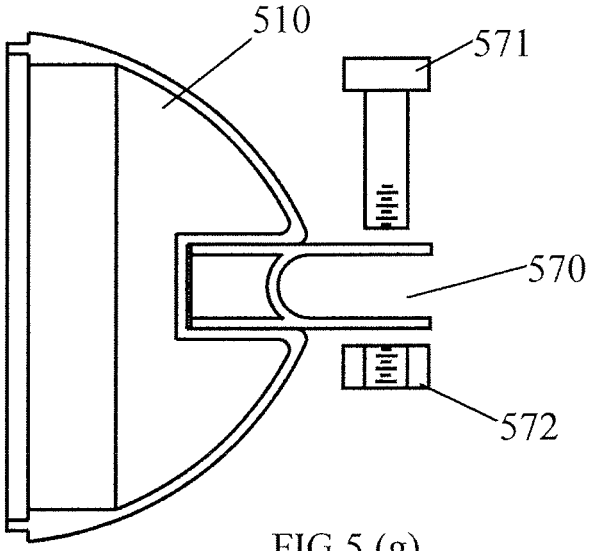

FIG. 5(*a*)-(*g*) are cross-section views of the first piece 510 of buoy 510 with a recess 515 for different attachments. Other examples of recesses 515 include, but are not limited to, recess 123, recess 461, or the opening of the through hole 223 or 270.

FIG. 5(*a*) is a cross-section view of the piece 510 and different types of attachments such as but not limited to an eye 520, a stud 530, a threaded stud 540, a threaded insert 550, a pipe 560 and clevis 570 having a bolt 571 and a nut 572, attachable to the piece 510 by being received in the recess 515 with or without additional bonding or mechanical engagements with the piece 510. The attachments are, in further embodiments, molded in, glued in or on, or by some other types of attachments at any place on the buoy piece to accommodate any attachment of any type.

FIG. 5(*b*) is a cross-section view of the piece 510 with the eye 520 attached.

FIG. 5(*c*) is a cross-section view of the piece 510 with the stud 530 attached.

FIG. 5(*d*) is a cross-section view of the piece 510 with the threaded stud 540 with external threads.

FIG. 5(*e*) is a cross-section view of the piece 510 with the threaded insert 550 with internal threads.

FIG. 5(*f*) is a cross-section view of the piece 510 with the pipe 560 attached.

FIG. 5(*g*) is a cross-section view of the piece 510 with the clevis 570 attached.

The buoy pieces in some embodiments use a gasket, an O-ring, or other methods to make a watertight joint.

Figure 6:
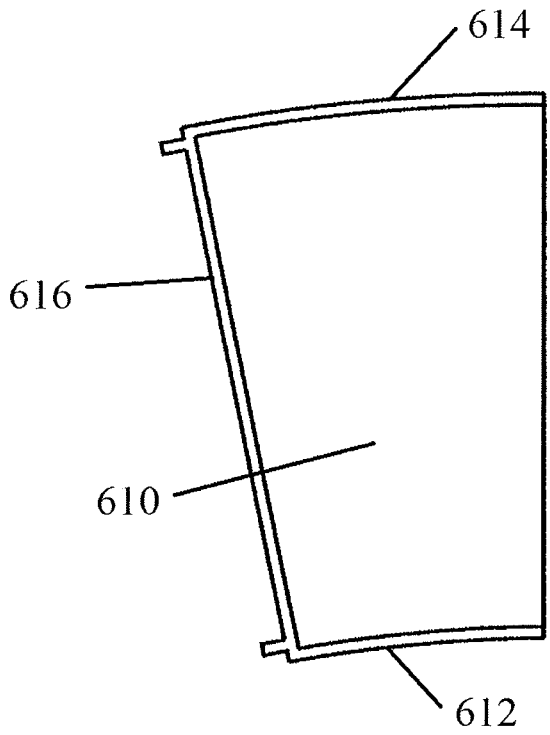
FIG. 6(*a*) is a top view of a section of a buoy piece according to another embodiment.
Figure 6:
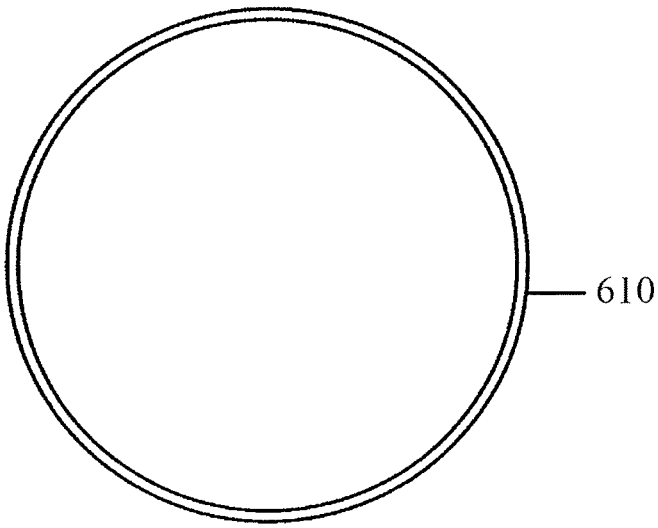

FIG. 6(*a*) is a top view of a section of a buoy piece according to another embodiment. As illustrated in FIG. 6(*a*), a section 610 that constitutes a buoy piece includes an end wall 616, an inner wall 612, and an outer wall 614. The inner wall 612 and the outer wall 614 are connected to the end wall 616. FIG. 6(*b*) shows a side view of the section 610 of the buoy piece according to the embodiment of FIG. 6(*a*). In this embodiment, the section 610 is O-ring-shaped, but other shapes are not excluded.

Figure 7:
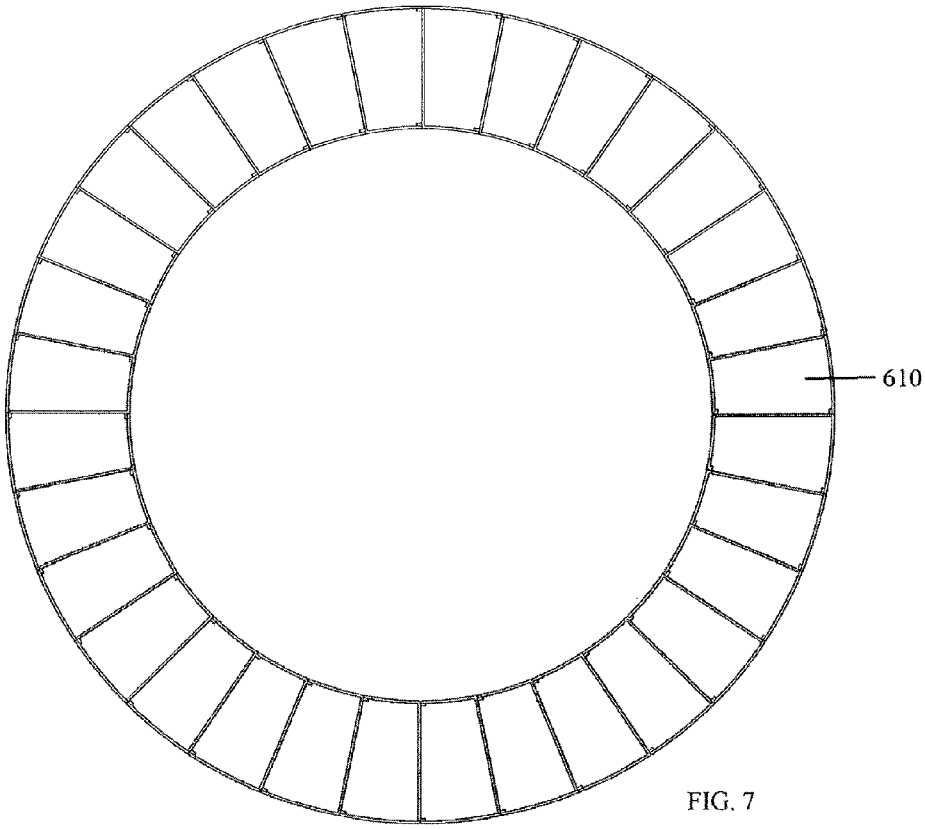
FIG. 7 is a top view of the buoy piece according to the embodiment of FIG. 6(*a*) when the sections of the buoy piece are in an assembled state.

FIG. 7 is a top view of the buoy piece according to the embodiment of FIG. 6(*a*) when the sections of the buoy piece are in an assembled state. As illustrated in FIG. 7, the sections 610 in this embodiment are assembled together to form a donut-shaped buoy piece. Some embodiments permit lobstermen and others to use many different sizes and shapes of buoys.

Figure 8:
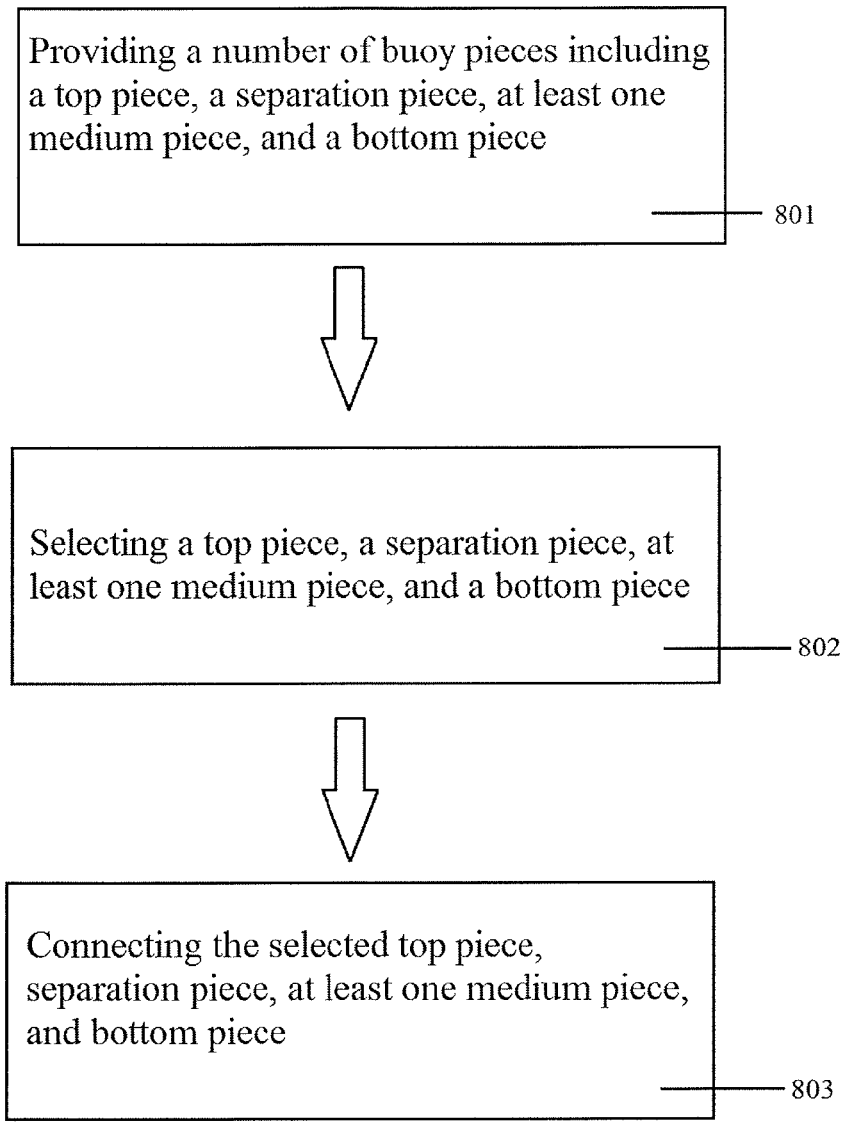
FIG. 8 is a flow chart of a method of assembling a buoy according to at least one embodiment.

FIG. 8 is a flow chart 600 of a method of assembling a buoy according to at least one embodiment. The method depicted in FIG. 8 is merely illustrative. Accordingly, it is understood that, in some embodiments, additional operations are performed before, during and/or after the method of FIG. 8.

In operation 801, a number of buoy pieces including a top piece, a separation piece, at least one medium piece, and a bottom piece is provided. Then, in operation 802, a top piece, a separation piece, at least one medium piece, and a bottom piece are selected from the pieces. The process proceeds to operation 803, where the selected top piece, separation piece, at least one medium piece, and bottom piece are connected in series to form the buoy with at least three watertight air compartments.

The foregoing outlines features of several embodiments so that those ordinarily skilled in the art may better understand the aspects of the present disclosure. Those ordinarily skilled in the art should appreciate that they may readily use the present disclosure as a basis for designing or modifying other processes and structures for carrying out the same or similar purposes and/or achieving the same or similar advantages of the embodiments introduced herein. Those ordinarily skilled in the art should also realize that such equivalent constructions do not depart from the spirit and scope of the present disclosure, and that they may make various changes, substitutions, and alternations herein without departing from the spirit and scope of the present disclosure.

We claim:

1. A buoy, comprising:

a first piece with a first cavity defined by a first sidewall, a first open end and a first closed end which is opposite to the first open end;

a second piece having a second cavity defined by a second sidewall, a second open end and a second closed end which is opposite to the second open end; and a separation piece to separate the first cavity and the second cavity so as to form two separated watertight compartments, wherein the first sidewall includes a first portion, a second portion thinner than the first portion and defining a periphery of the first open end, and a shoulder between the first portion and the second portion, wherein the separation piece is a plate having a peripheral portion resting on the shoulder of the first sidewall, and wherein the second sidewall and the second portion of the first sidewall are fitted over each other and form a watertight joint therebetween.

2. The buoy according to claim 1, wherein the first piece, the second piece and the separation piece have a common central axis.

3. The buoy according to claim 1, wherein the first piece further comprising an attaching portion for receiving an attachment to the first piece.

4. The buoy according to claim 1, wherein the separation piece is made of water impermeable material.

5. The buoy according to claim 2, wherein each of the first piece, the second piece and the separation piece has a through hole defined by a tubular wall along the common central axis.

6. The buoy according to claim 2, wherein the separation piece comprises a first portion and a second portion along the central axis, an upper surface of the second portion is higher than the upper surface of the first portion, and a lower surface of the second portion is lower than the lower surface of the first portion.

7. The buoy according to claim 1, further comprising a ring which is attached to the first piece, and through which a rope is passable.

8. The buoy according to claim 1, the first piece further comprising a recess for receiving an attachment to the buoy.

9. The buoy according to claim 1, wherein one or more of the first piece, and the second piece is molded in color for color identification.

10. The buoy according to claim 9, wherein color pigments are molded in one or more of the first piece, and the second piece so as to eliminate repeated painting.

11. The buoy according to claim 1, wherein any one or more of the first piece, and the second piece defines at least one stripe or ring with color for color identification.

12. The buoy according to claim 1, wherein the first piece, the separation piece, and the second piece are made of plastic materials.

13. The buoy according to claim 1, wherein the first piece or the second piece has an annular shape.

14. A method of assembling a buoy from a number of buoy pieces including:

at least one top piece with a first cavity at least one middle piece having a second cavity;

at least one bottom piece having a third cavity the method comprising:

selecting a top piece, and a bottom piece from the buoy pieces; and connecting the selected pieces in series to form the buoy which has a watertight joint between each pair of the connected pieces, wherein said pair of the connected pieces have corresponding first and second sidewalls, the first sidewall includes a first portion, and a second portion thinner than the first portion, and the second sidewall and the second portion of the first sidewall are fitted over each other and form the watertight joint therebetween, and at least one watertight air compartment defined by at least one of the first and third cavities.

15. The method of claim 14, further comprising:

additionally selecting at least one middle piece from the buoy pieces; and connecting the selected top piece, at least one middle piece, and bottom piece in series to form the buoy which has watertight joints between the connected pieces, wherein sidewalls of the top piece and the at least one middle piece are fitted over each other and form the corresponding watertight joint therebetween, and sidewalls of the at least one middle piece and the bottom piece are fitted over each other and form the corresponding watertight joint therebetween, and at least two separate watertight air compartments each defined by at least one of the first, second and third cavities.

16. The buoy according to claim 1, further comprising:

at least one additional second piece defined by an additional second sidewall, an additional second open end and an additional second closed end which is opposite to the additional second open end, wherein the additional second sidewall at the additional second open end of the at least one additional second piece and the second sidewall at the second closed end of the second piece are fitted over each other and form a watertight joint therebetween.

17. The buoy according to claim 16, further comprising:

a third piece defined by a third sidewall, a third open end and a third closed end which is opposite to the third open end, wherein the third sidewall at the third open end of the third piece and the additional second sidewall at the additional second closed end of the additional second piece are fitted over each other and form a watertight joint therebetween.

18. The buoy according to claim 17, wherein one or more of the first piece, the second pieces and the third piece is molded in color or defines at least one stripe or ring with color for color identification.

19. The buoy according to claim 17, wherein the first piece, the separation piece, the second pieces and the third piece are made of plastic materials.

* * * * *